US011686483B2

(12) United States Patent
Branham

(10) Patent No.: US 11,686,483 B2
(45) **Date of Patent: *Jun. 27, 2023**

(54) VENTILATION FAN MOUNTING ASSEMBLY

(71) Applicant: Ascent Holdings, LLC, Gig Harbor, WA (US)

(72) Inventor: Tony J. Branham, Gig Harbor, WA (US)

(73) Assignee: Ascent Holdings, LLC, Gig Harbor, WA (US)

( * ) Notice: Subject to any disclaimer, the term of this patent is extended or adjusted under 35 U.S.C. 154(b) by 126 days.

This patent is subject to a terminal disclaimer.

(21) Appl. No.: 17/199,782

(22) Filed: Mar. 12, 2021

(65) Prior Publication Data

US 2021/0199319 A1 Jul. 1, 2021

Related U.S. Application Data

(63) Continuation of application No. 16/243,666, filed on Jan. 9, 2019, now Pat. No. 11,015,822.

(51) Int. Cl.

| | |
|---|---|
| ***F24F 7/06*** | (2006.01) |
| ***F24F 13/20*** | (2006.01) |
| ***F04D 29/42*** | (2006.01) |
| *F24F 7/00* | (2021.01) |

(52) U.S. Cl.

CPC ..... *F24F 7/06* (2013.01); *F04D 29/4226* (2013.01); *F24F 13/20* (2013.01); *F24F 2007/001* (2013.01); *F24F 2013/205* (2013.01); *F24F 2221/14* (2013.01); *F24F 2221/17* (2013.01)

(58) Field of Classification Search

None

See application file for complete search history.

(56) References Cited

U.S. PATENT DOCUMENTS

| | | | |
|---|---|---|---|
| 2,650,021 | A | 8/1953 | Morrill |
| 2,961,115 | A | 11/1960 | Aylor |
| 2,963,783 | A | 12/1960 | Field |
| 4,009,894 | A | 3/1977 | Marquette et al. |
| 4,294,476 | A | 10/1981 | Nash |

(Continued)

FOREIGN PATENT DOCUMENTS

| | | | |
|---|---|---|---|
| CN | 102469850 | A | 5/2012 |
| CN | 103234252 | A | 8/2013 |

(Continued)

*Primary Examiner* — Juan G Flores

(74) *Attorney, Agent, or Firm* — Seed Intellectual Property Law Group LLP

(57) ABSTRACT

An assembly for use in mounting an object in an opening in a structural member, the structural member having opposing first and second surfaces, the assembly including a housing that is sized and shaped to define an interior to house the object and that can be received within the opening in the structural member, a trim ring sized and shaped to fit within the interior of the housing and to bear against the second surface of the structural member, and a cover having a first panel sized and shaped to cover the trim ring, the cover having a connector that releasably connects the cover to the housing, the cover further including at least one standoff extending therefrom that is sized and shaped to bear against the trim ring to hold the trim ring in place.

12 Claims, 18 Drawing Sheets

(56) References Cited

U.S. PATENT DOCUMENTS

| | | | | |
|---|---|---|---|---|
| 4,491,124 | A | 1/1985 | Goettel | |
| 4,550,648 | A | 11/1985 | Eagle | |
| 4,684,092 | A | 8/1987 | Reiker | |
| 4,834,615 | A | 5/1989 | Mauch et al. | |
| 5,044,987 | A | 9/1991 | Tihanyi | |
| 5,152,117 | A | 10/1992 | Wynar | |
| 5,211,580 | A | 5/1993 | Schuplin | |
| 5,314,212 | A | 5/1994 | Sanders | |
| 5,393,106 | A | 2/1995 | Schroeder | |
| 5,518,277 | A | 5/1996 | Sanders | |
| 5,520,509 | A | 5/1996 | Zimmerman | |
| 5,538,293 | A | 7/1996 | Kolt | |
| 5,799,446 | A | 9/1998 | Tamlyn | |
| 5,906,475 | A | 5/1999 | Melane et al. | |
| 5,957,506 | A | 9/1999 | Stepp | |
| 6,369,326 | B1 | 4/2002 | Rippel et al. | |
| 6,488,579 | B2 | 12/2002 | Larson et al. | |
| 6,722,971 | B2 | 4/2004 | Gough | |
| 6,802,770 | B2 | 10/2004 | Larson et al. | |
| 7,011,578 | B1 | 3/2006 | Core | |
| 7,455,500 | B2 | 11/2008 | Penlesky et al. | |
| 7,530,717 | B2 | 5/2009 | Magisano et al. | |
| 7,722,208 | B1 | 5/2010 | Dupre et al. | |
| 7,940,525 | B2 | 5/2011 | Létourneau | |
| 7,987,649 | B1 | 8/2011 | Polston | |
| 8,486,525 | B2 | 7/2013 | Segur | |
| 8,985,364 | B2 * | 3/2015 | Gagne | H02G 3/123 52/656.1 |
| 9,222,266 | B1 | 12/2015 | Conboy | |
| 9,591,390 | B2 | 3/2017 | Humphreys et al. | |
| 9,689,581 | B2 | 6/2017 | Zakula et al. | |
| 10,352,584 | B2 | 7/2019 | Huang et al. | |
| 11,015,822 | B2 * | 5/2021 | Branham | F24F 7/06 |
| 2008/0232116 | A1 * | 9/2008 | Kim | F21V 29/83 362/365 |
| 2008/0318515 | A1 * | 12/2008 | Yeung | F04D 29/626 454/343 |
| 2009/0186572 | A1 | 7/2009 | Farrell | |
| 2011/0017742 | A1 | 1/2011 | Sausen et al. | |
| 2013/0130612 | A1 | 5/2013 | Penlesky et al. | |
| 2015/0219118 | A1 | 8/2015 | Zakula et al. | |
| 2016/0108925 | A1 * | 4/2016 | Huang | F24F 7/007 415/121.3 |
| 2019/0032953 | A1 | 1/2019 | Branham | |

FOREIGN PATENT DOCUMENTS

| | | | |
|---|---|---|---|
| CN | 207989371 | U | 10/2018 |
| JP | 2001-4187 | A | 1/2001 |
| JP | 2002-310093 | A | 10/2002 |

* cited by examiner

VENTILATION FAN MOUNTING ASSEMBLY

BACKGROUND

Technical Field

The present disclosure pertains to the mounting of objects within a structural member, such as a wall, ceiling, and the like and, more particularly, to a ceiling or wall exhaust fan mounting apparatus employing trim rings and covers for simplified and secure installation, effective movement of air and vapor, and the presentation of an appealing appearance that facilitates a reduced height and room-side installation.

Description of the Related Art

Installation of objects, such as fans, light fixtures, controls, and the like in the interior of a residence or business can be complex and time consuming. In addition to the task of forming the correct opening, the installer must adequately fasten the object to the structural support. This requires the use of the correct fasteners, tools, and proper technique, and it typically requires access to the back side of the surface, such as via an attic for ceiling mount locations. It is desirable to provide a housing and mounting system that enables the installer to mount the housing from the interior of the room or space and thus avoid having the installer access the back side of the structural member, such as entering an attic or crawl space to install the housing. It is also desirable to provide for mounting to the structural member without the use of fasteners or tools, and to facilitate connection to existing or new ducting within a constrained space.

BRIEF SUMMARY

The present disclosure is directed to a ventilation fan mounting assembly that facilitates installation of an object, such as a ventilation or exhaust fan, in a rough opening in a structural member, for example a wall or ceiling, provides an effective air seal to increase the effectiveness of evacuation of air and vapor through the ventilation fan, as well as presents an attractive cosmetic appearance when mounted. In accordance with one implementation of the present disclosure, a housing assembly is provided that includes at least one wall circumscribing an interior space that is sized and shaped to accommodate the object. The at least one wall has a distal end, a first tab extending from the distal end, and a second tab extending from the distal end, the first tab sized and shaped to engage a first side of the structural member to retain the housing in the rough opening of the structural member, and the second tab sized and shaped to engage a second side of the structural member adjacent the rough opening and attach the housing to the structural surface.

In accordance with another aspect of the present disclosure, the first and second tabs are integrally formed with the at least one wall and are co-planar with the at least one wall, the first and second tabs formed of bendable material that retains a bent shape and can be bent back to an original position, the first and second tabs having a thickness that enables manual bending of the first and second tabs from the original position to at least an angle of 90 degrees with respect to the at least one wall.

In accordance with a further aspect of the present disclosure, the first and second tabs are capable of being bent more than once without breaking. Ideally, the first and second tabs are formed of a material and of a thickness that facilitates manual bending of the tabs by hand and without requiring tools, yet remaining in place under load.

In accordance with still yet another aspect of the present disclosure, an assembly for use in mounting an object in an opening in a structural member, the structural member having opposing first and second surfaces, is provided. The assembly includes a housing that is sized and shaped to define an interior to house the object and that can be received within the opening in the structural member, a trim ring sized and shaped to fit within the interior of the housing and to bear against the second surface of the structural member, and a cover having a panel sized and shaped to cover the trim ring, the cover having a connector that releasably connects the cover to the housing, the cover further including at least one standoff extending therefrom that is sized and shaped to bear against the trim ring to hold the trim ring in place.

In accordance with another aspect of the present disclosure, a ventilation assembly for mounting a ventilation fan in an opening in a structural member without tools, the structural member having opposing first and second surfaces, is provided. The assembly includes a housing that is sized and shaped to define an interior that is capable of housing the ventilation fan and that can be slidably received within the opening in the structural member, a trim ring having a first wall sized and shaped to fit within the interior of the housing and a ledge extending from the first wall to bear against the second surface of the structural member, and a cover having a first panel sized and shaped to cover the trim ring, the cover having a connector that releasably connects the cover to the housing, the cover further including at least one standoff extending therefrom that is sized and shaped to bear against the trim ring to hold the trim ring in place.

In accordance with another aspect of the present disclosure, the trim ring has an interference fit or friction fit in the housing, including friction fit notches to hold it in place.

BRIEF DESCRIPTION OF THE SEVERAL VIEWS OF THE DRAWINGS

The foregoing and other features and advantages of the present disclosure will be more readily appreciated as the same become better understood from the following detailed description when taken in conjunction with the accompanying drawings, wherein.

DETAILED DESCRIPTION

Figure 1:
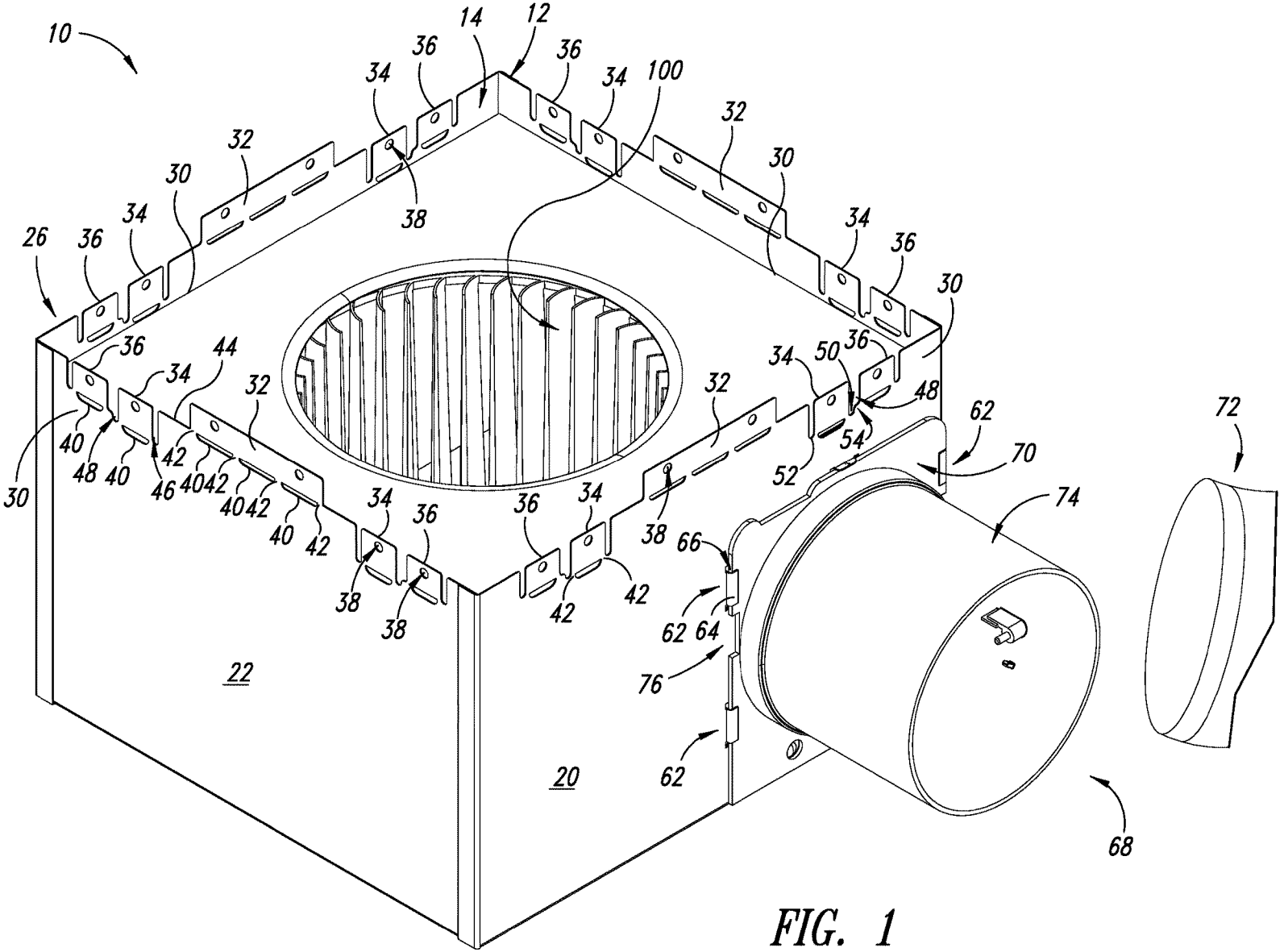
FIG. 1 is a bottom, right, front axonometric view of a fan housing formed in accordance with the present disclosure.
Figure 2:
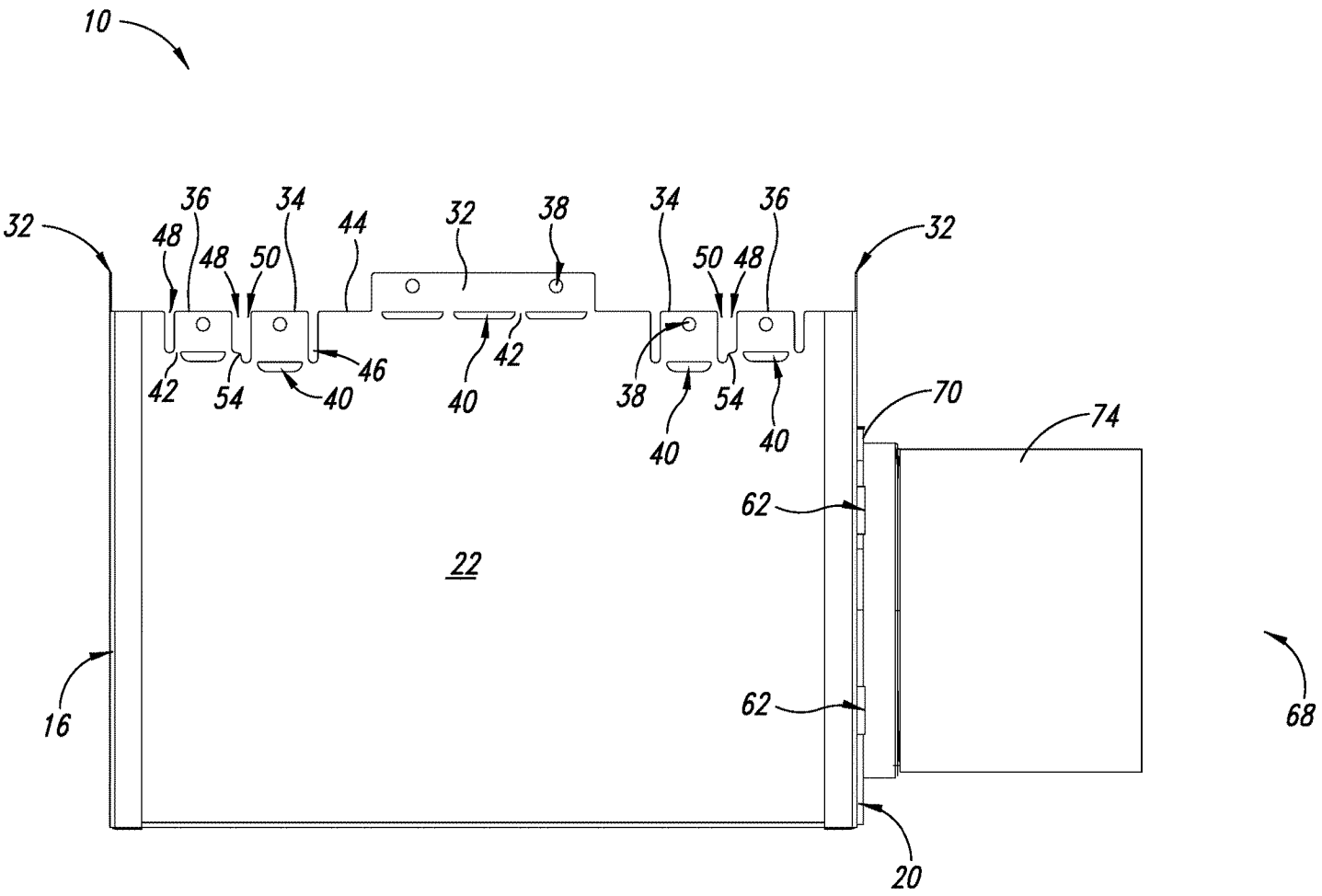
FIG. 2 is a right side elevational view thereof.
Figure 3:
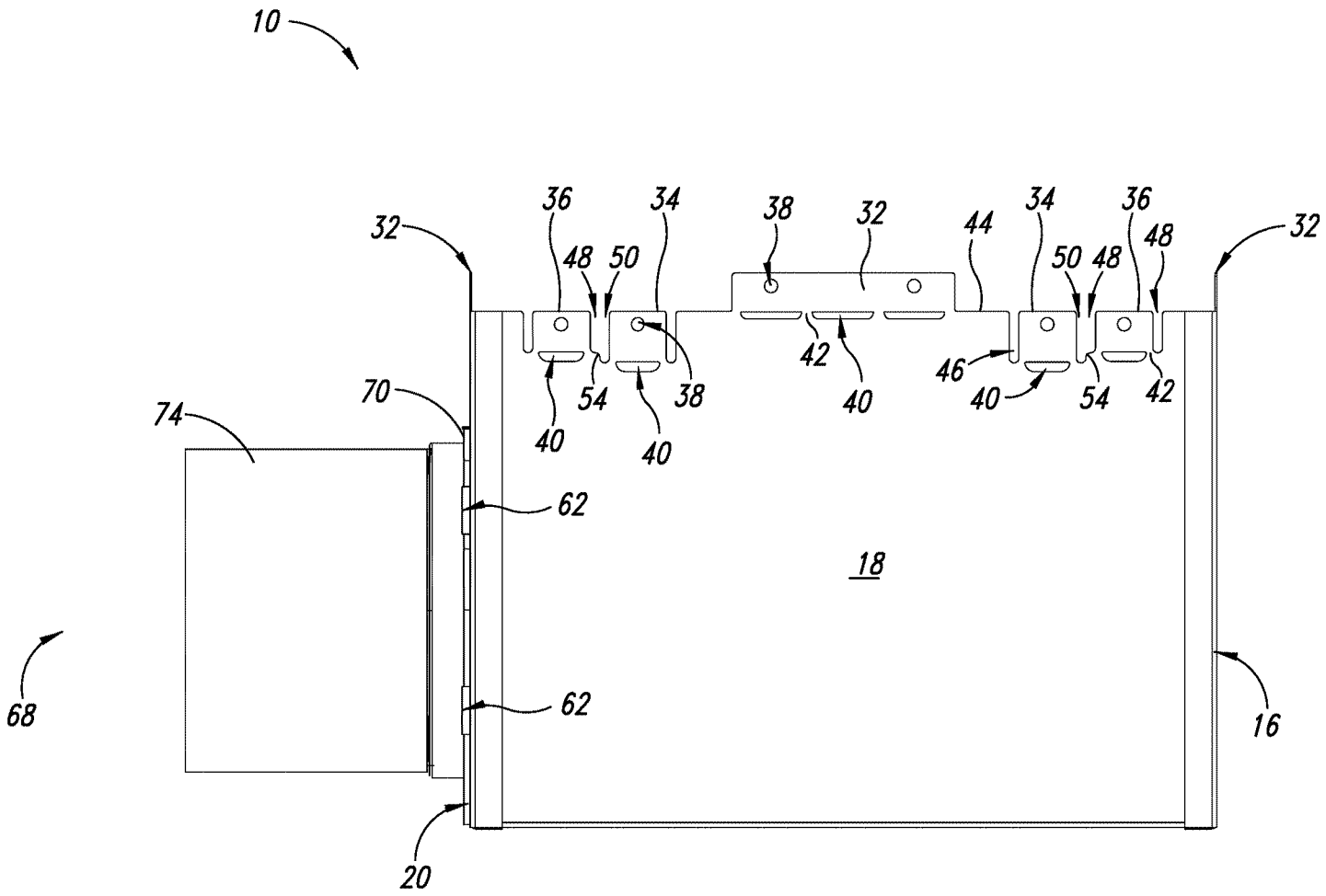
FIG. 3 is a left side elevational view thereof.
Figure 4:
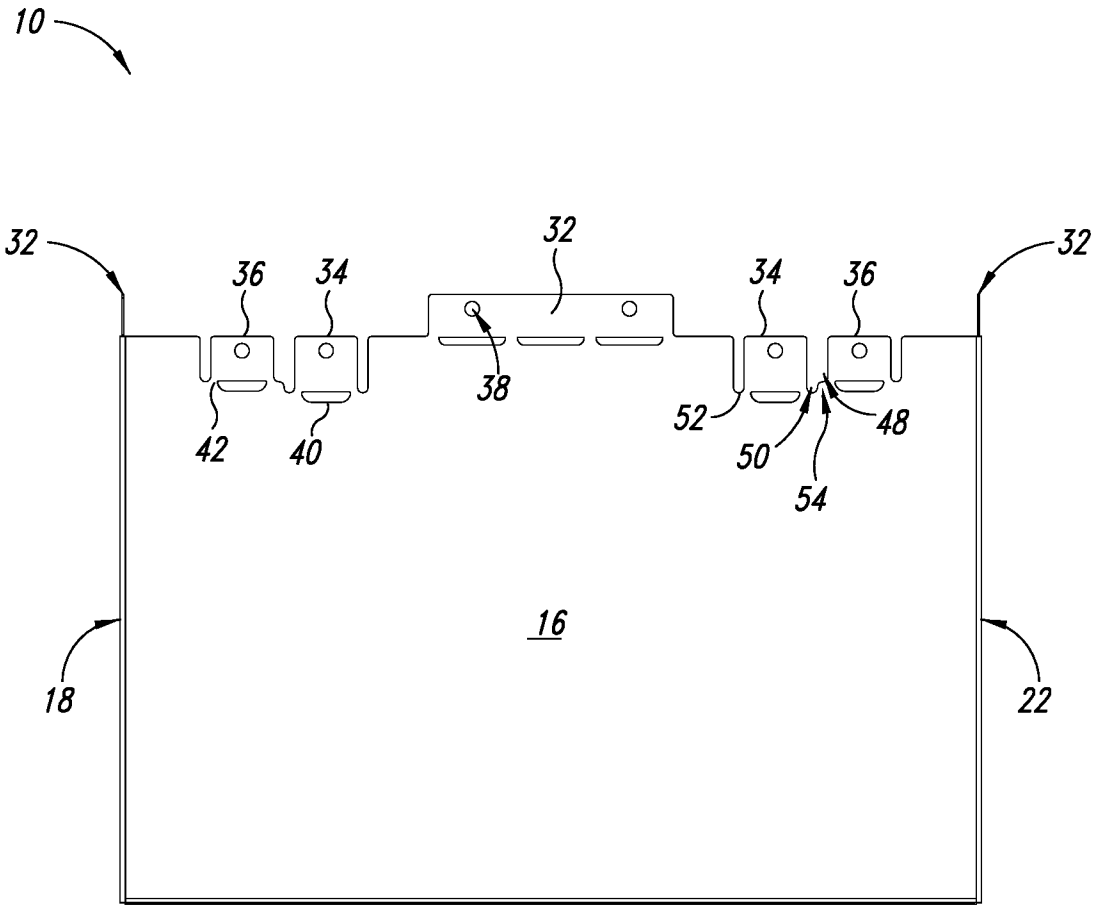
FIG. 4 is a rear elevational view thereof.
Figure 5:
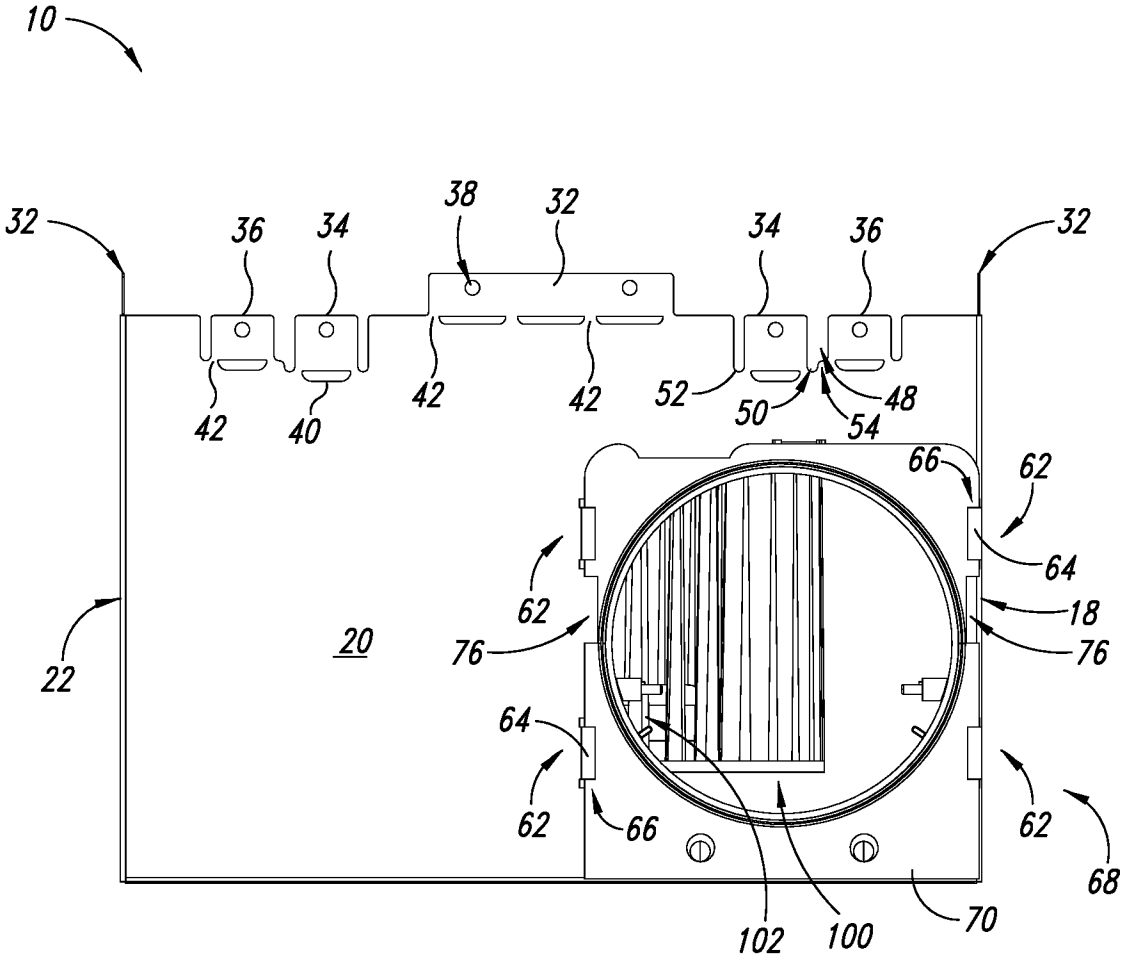
FIG. 5 is a front elevational view thereof.
Figure 6:
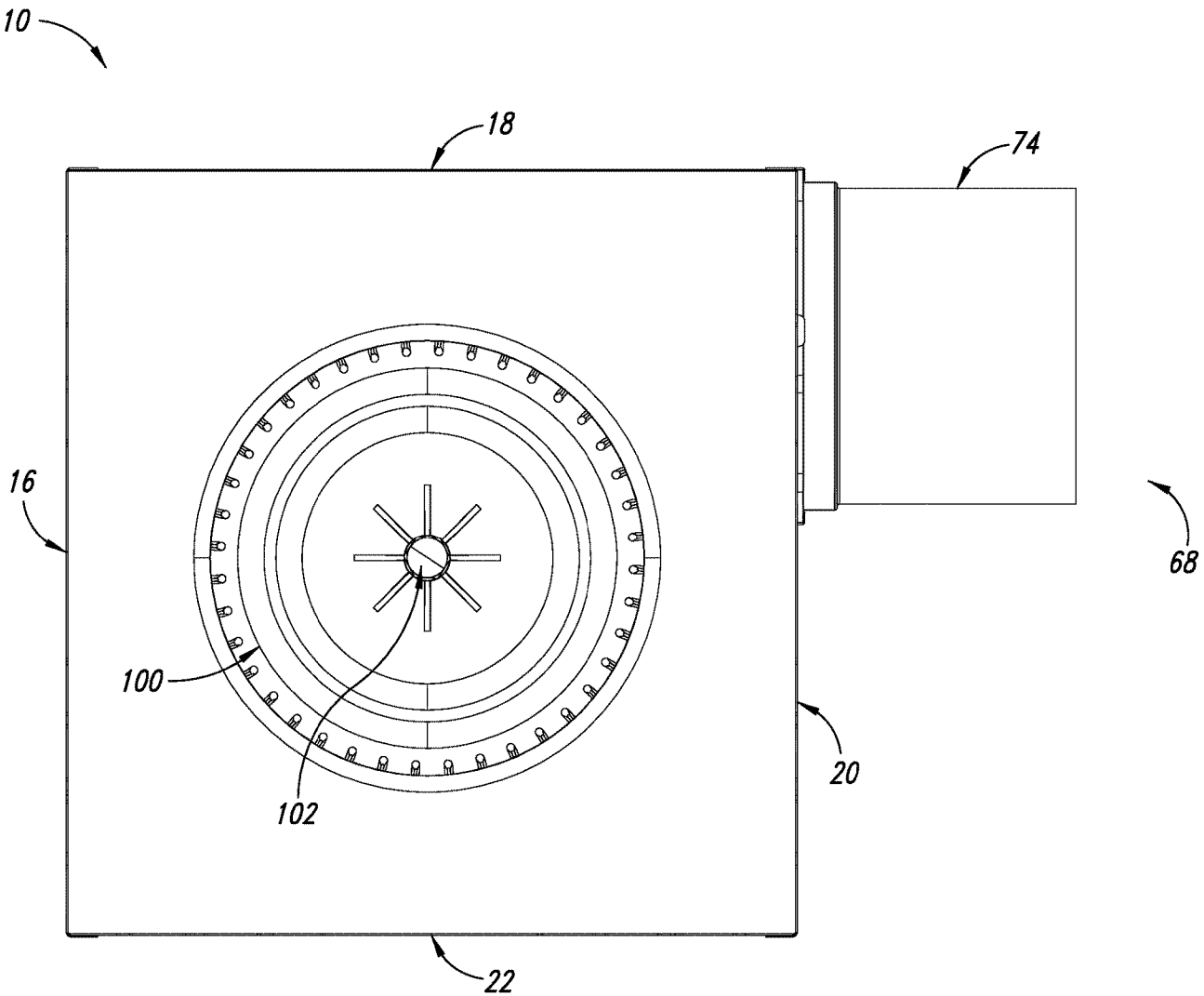
FIG. 6 is a bottom plan view thereof.
Figure 7:
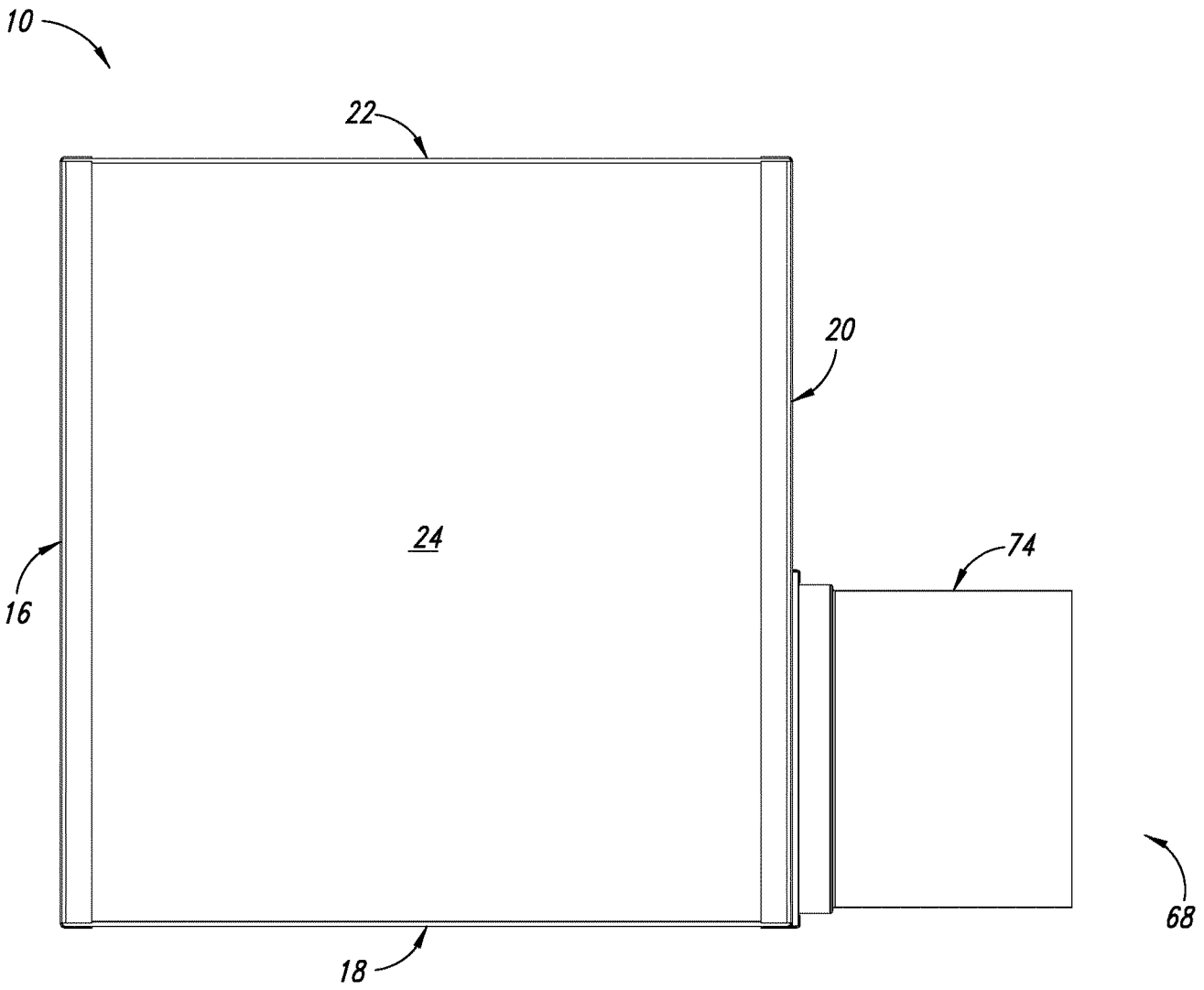
FIG. 7 is a top plan view thereof.
Figure 8A:
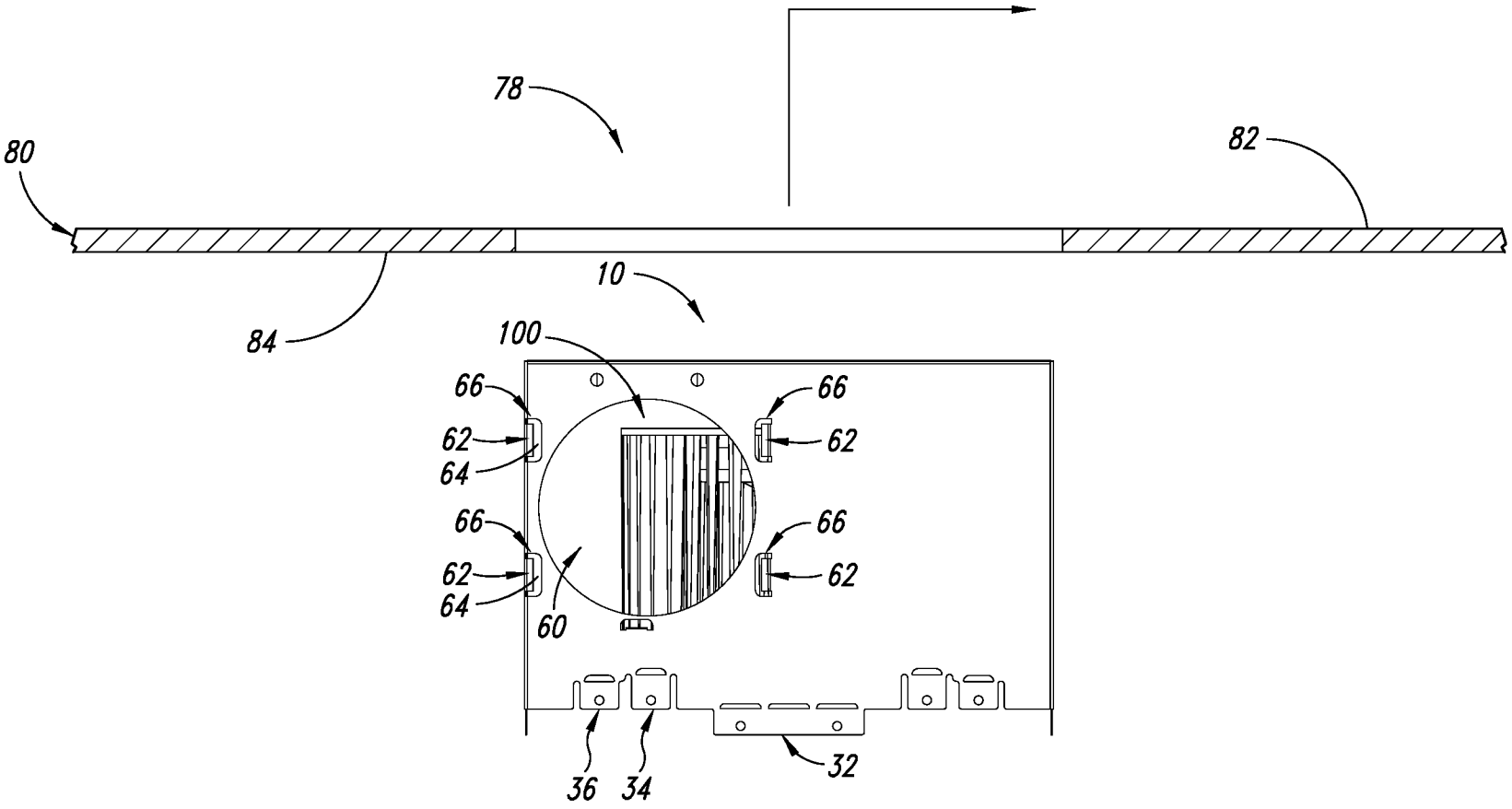
FIG. 8A is a partial cross-sectional front view of the housing below a rough opening prior to installation.
Figure 8B:
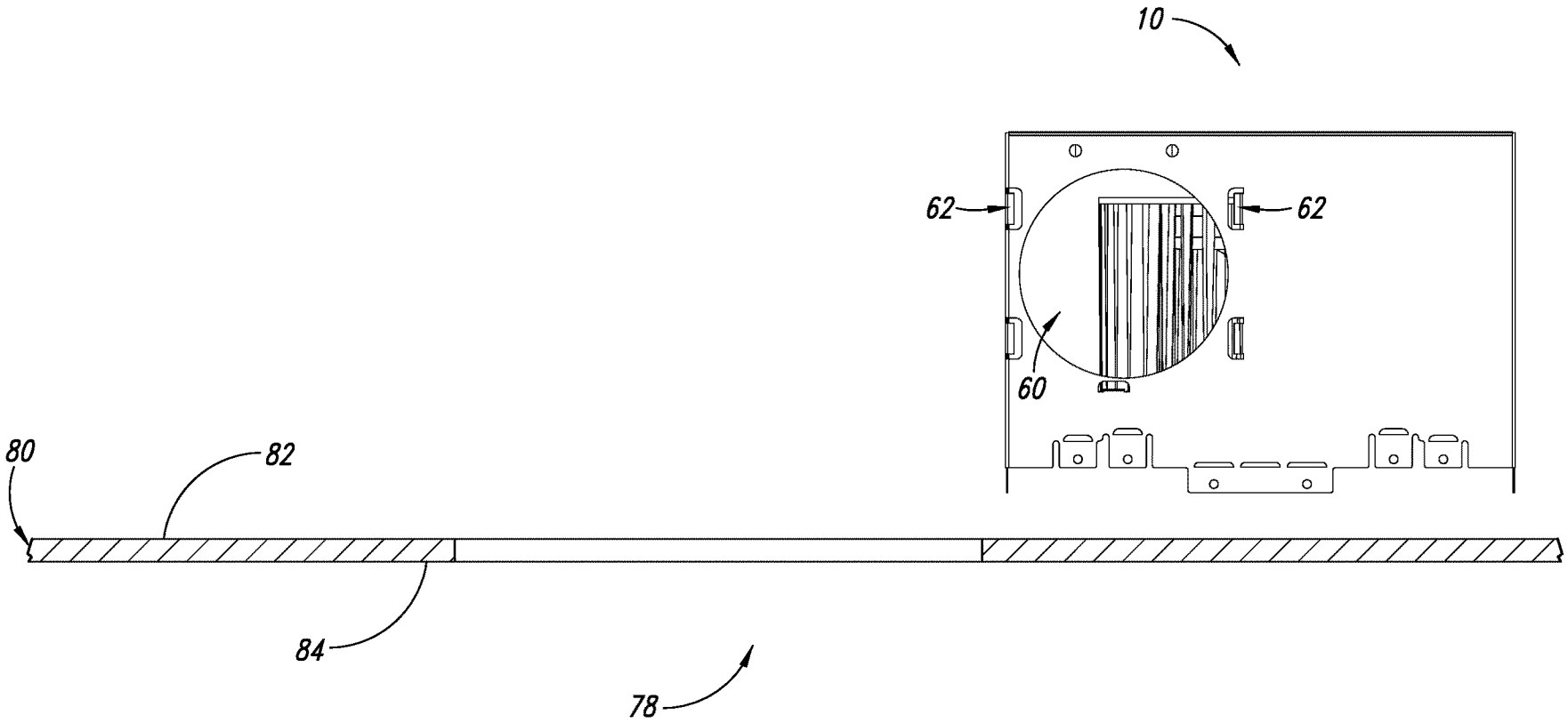
FIG. 8B is a partial cross-sectional front view of the housing inserted through the rough opening and positioned above the ceiling to the side of the rough opening.
Figure 9A:
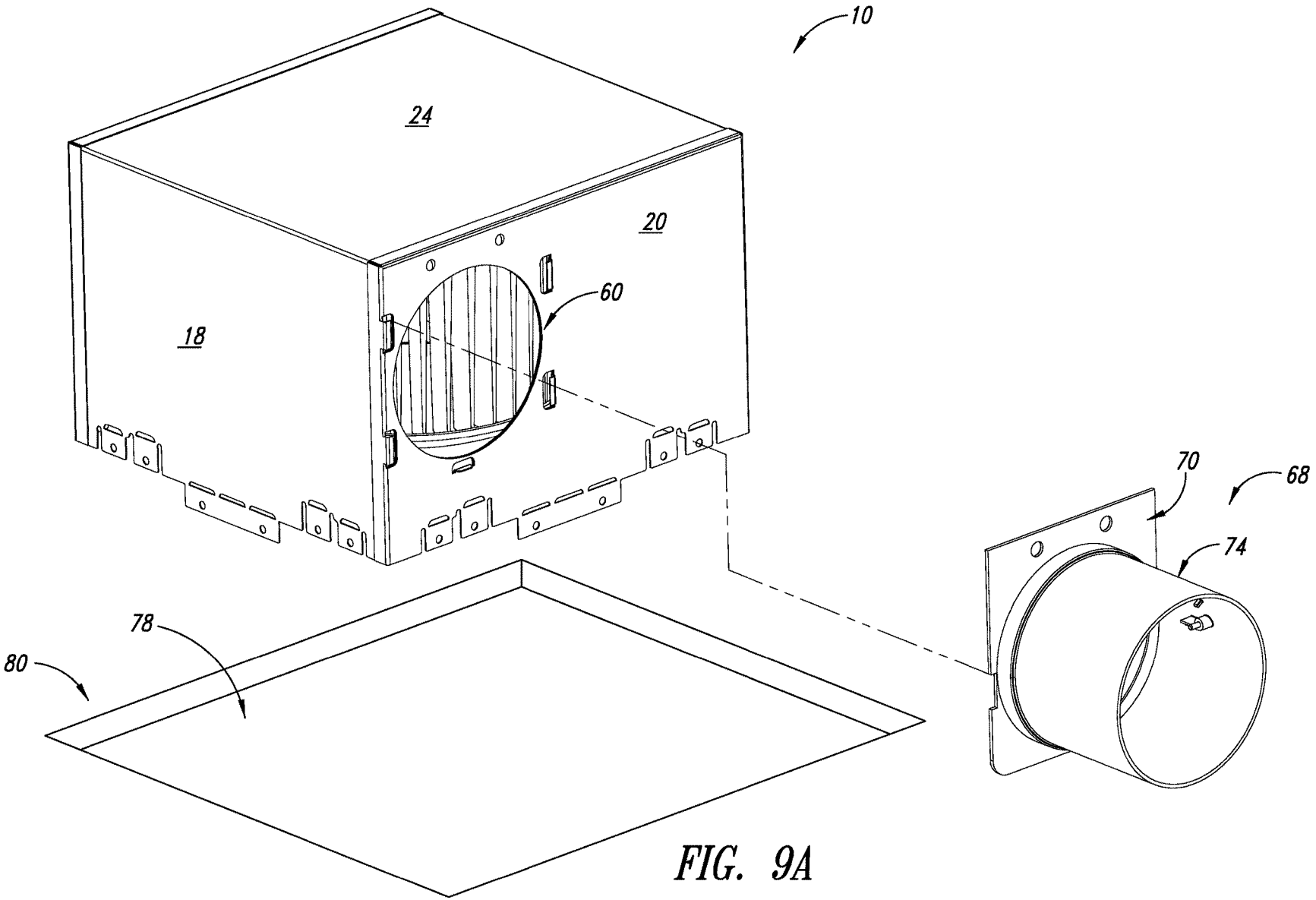
FIG. 9A illustrates the housing positioned above the rough opening with the vent duct connector in exploded view.
Figure 9B:
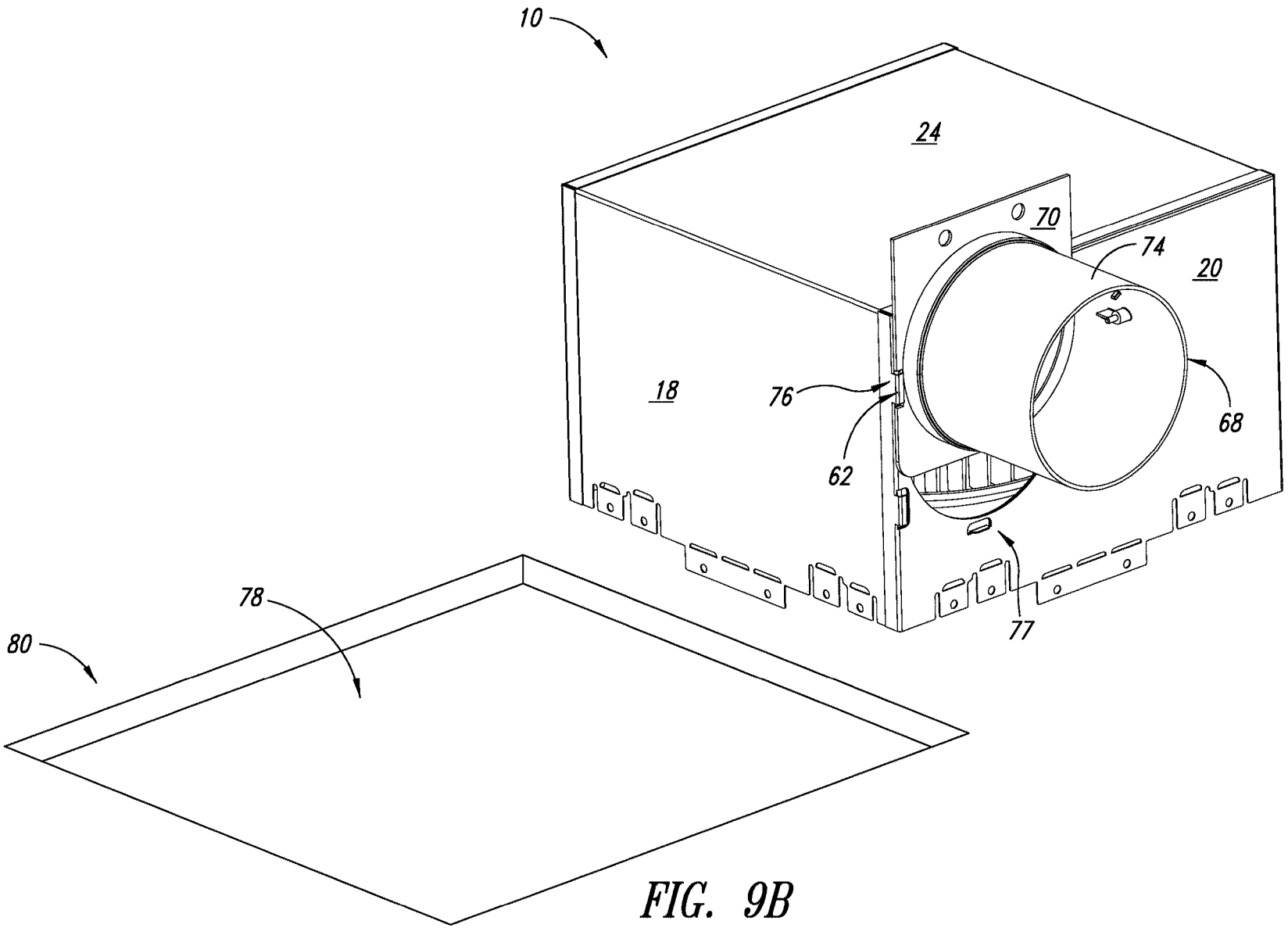
FIG. 9B illustrates the vent duct connector in an initial orientation against the housing.
Figure 9C:
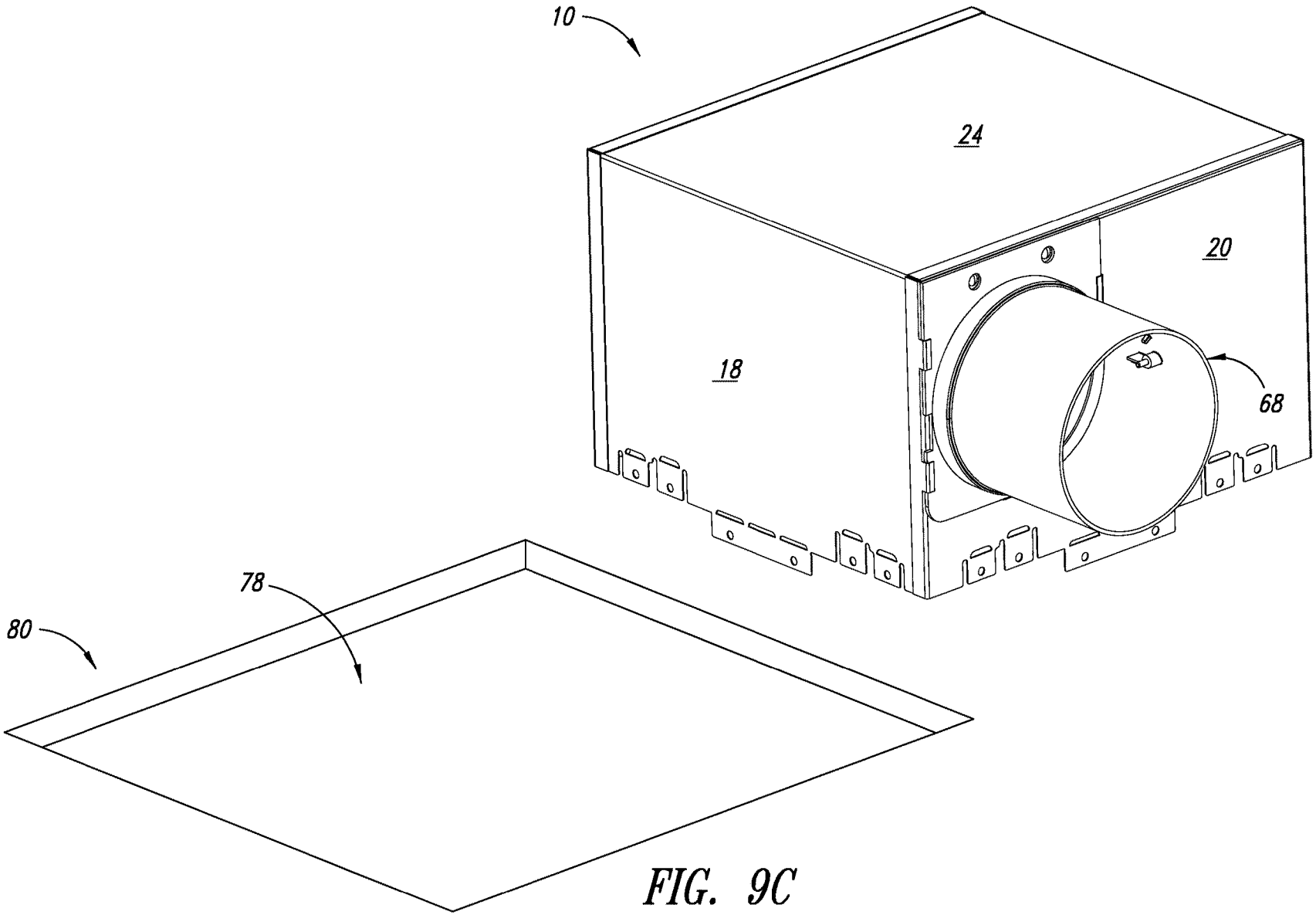
FIG. 9C shows the vent duct connector slid down the tracks into an installed position.

In the following description, certain specific details are set forth in order to provide a thorough understanding of various disclosed implementations. However, one skilled in the relevant art will recognize that implementations may be practiced without one or more of these specific details, or with other methods, components, materials, etc. In other instances, well-known structures or components or both associated with the use of fans, ducting, panels, walls, ceilings, and doors, as well as framing for walls, ceilings, doors, and the like, and installation processes for ceiling and wall fans have not been shown or described in order to avoid unnecessarily obscuring descriptions of the implementations.

Unless the context requires otherwise, throughout the specification and claims that follow, the word "comprise" and variations thereof, such as "comprises" and "comprising" are to be construed in an open inclusive sense, that is, as "including, but not limited to." The foregoing applies equally to the words "including" and "having."

Reference throughout this description to "one implementation" or "an implementation" means that a particular feature, structure, or characteristic described in connection with the implementation is included in at least one implementation. Thus, the appearance of the phrases "in one implementation" or "in an implementation" in various places throughout the specification are not necessarily all referring to the same implementation. Furthermore, the particular features, structures, or characteristics may be combined in any suitable manner in one or more implementations.

Referring to FIGS. 1-7, shown therein is a housing 10 formed of at least one wall 12 that defines an interior space 14. Ideally the fan housing 10 has the fan 100, motor 102, and electrical connection (not shown) in the housing interior space 14 when it is sold or installed, although this is not required. The at least one wall 12 is formed to have a square planform shape defined by four sidewalls 16, 18, 20, 22 that are preferably—but not required to be—orthogonal to adjacent sidewalls, each sidewall 16, 18, 20, 22 having a substantially square or rectangular shape. An end wall 24 is formed at a closed end 26 of the housing 10, while the opposing side is an open end. The cross-sectional configuration of the housing is that of a rectangle, and the shorter walls 16, 20 cooperate with the longer walls 18, 22 to form a rectangular planform shape. It is to be understood that the cross-sectional shape may vary from a circle to any number of sides (polygon), and other geometric shapes, such as triangle (with three sides) or square, and the three-dimensional housing shape may take other forms, such as a cone.

Each of the sidewalls 16, 18, 20, 22 has a distal end 30 on which is formed a plurality of tabs that include a center tab 32, a pair of intermediate tabs 34, one on each side of and adjacent to the center tab 32, and a pair of outside tabs 36, each outside tab 36 adjacent to a respective intermediate tab 34. Although referred to as tabs, it is to be understood that a tab can be a flange, flap, strip, or similar component. Each tab 32, 34, 36 has optional openings 38 for a fastener if desired. The housing 10 is preferably formed of material, such as aluminum or other material having similar properties, with a thickness that permits manual bending of the tabs about the supporting legs as described below, in order to enable mounting of the housing 10 to a structural member, also as described below. The intermediate tabs 34 and outside tabs 36 extend upward to terminate evenly with the distal edge 44 of their respective wall 16, 18, 20, 22.

Ideally, each of the tabs 32, 24, 36 is co-planar with its respective wall 16, 18, 20, 22, when initially formed. However, the tabs 32, 24, 36 have a different bendable length and different bend lines to limit the length of the tab when it is repositioned to a bent configuration. Ideally the tabs 32, 34, 36 are formed to be bent at substantially a 90 degree angle to be orthogonal to the respective wall 16, 18, 20, 22 to which it is formed. For example, center tab 32 has one or more elongate openings 40 formed at the intersection of the center tab 32 and the respective wall 16, 18, 20, 22. The size and shape of these openings 40 is a matter of design choice and aesthetic appearance. Between these openings 40 are legs 42 that support the tab 32 on the wall 16, 18, 20, 22 and that enable bending in response to a manual force exerted on the tab 32. The manual force is preferably that of a human hand or the fingers of the human hand. Hence, the center tab 32 can be repositioned by manually bending about the legs 42 in a range of about 180 degrees either direction and, more preferably, to be orthogonal to the respective wall 16, 18, 20, 22, either towards the interior 14 or towards the exterior of the housing 10, which is described more fully below.

The center tab 32 extends further than the terminal end or distal edge 44 of the respective wall 16, 18, 20, 22 a sufficient distance that, when the housing 10 is placed in the rough opening, the center tab 32 extends down below the exterior surface of the structural member (in this case a ceiling or wall).

The intermediate tab 34 is formed by two longitudinal elongate openings 46, 48 on each side of the tab 34 of equal length. An elongate opening 40 is formed below the intermediate tab 24 and between the two longitudinal elongate openings 46 to form two support legs 42 that are sized and shaped to yield to a manual force asserted on the intermediate tab 34, and to bend up to and beyond a 90 degree angle, such as about 180 degrees either direction (limited by bend allowance). As such, the tab 34 can be repositioned to any angle from 0 to about 180 degrees or −180 degrees relative to the wall 22, including a preferred 90 degree or right angle. The length of the intermediate tab 34, when it is repositioned, is determined by the distance of the respective opening 40 from the distal edge 44 of the respective wall 16, 18, 20, 22.

The outside tab 36 is formed by two longitudinal openings 50, 52 on either side and of equal length. The longitudinal opening 50 is longer than the adjacent longitudinal opening 48, and it joins the longitudinal opening 48 with a stepped bottom edge 54. The outside tab 36 is thus supported by two legs 42, as are the other tabs, and these two legs are separated by an elongate opening 40. The legs 42 bend adjacent the elongate opening 40, as do the legs of the other tabs 32, 24. However, the outside tab 36 is longer than the intermediate tab 34 due to the length of the longitudinal openings 50, 52, and this will form a larger tab 36 when force is applied to the tab 36 and the legs 42 bend in either direction. As with the center tab 32 and intermediate tab 34, the outside tab 36 can bend up to about 180 degrees (considering bend allowance) in either direction relative to the respective wall 16, 18, 20, 22. In this design, the outside tab 36 has a width of about ½ inch when it is bent about the legs 42, and the intermediate tab 34 has a width of about ⅝ inch when it is bent about its supporting legs 42.

As shown in the drawings, a duct opening 60 is formed in one of the walls, in this case the longer wall 20, and adjacent one edge of the wall 20. The opening can have a round or square shape, although almost any geometric or irregular shape may be used as needed. There are two L-shaped guides 62 on opposing exterior sides of the vent duct opening 60, each L-shaped guide 62 has a leg 64 spaced away from the wall 20 to create a slot or track 66. A vent duct connector 68 is provided having a flange 70 that is sized and shaped to be slid into place in the slots or tracks 66 of the guides 62 after the ducting 72 is attached thereto. It is also possible to attach vent duct connector 68 to the housing 10 prior to attaching the ducting 72. The vent duct connector 68 has a cylindrical extension or tubular nozzle 74 (with a back draft swing damper—not shown). The tubular nozzle 74 is connected to the ducting 72 by sliding the ducting 72 in place over the nozzle 74, and a clamp may be used to secure the ducting in place, which is a conventional method of attaching ducting and will not be described in more detail herein.

A unique feature of the present design is the flange 70 material (preferably plastic) has two notches 76 on opposing sides that are sized and shaped to be slid over the L-shaped guides 62 so the vent duct connector 68 does not need to be raised up as high to get it started in the four tracks 66. This feature allows for a shallow opening installation.

Installation Process

A rough opening 78 is created in the structural member, here a ceiling 80, in which the fan and fan housing 10 in which the fan resides are to be mounted. The structural member can be a ceiling, a wall, a soffit, or other structural member of a residential or commercial building. Generally these structural members are formed from sheet rock or other interior wall or ceiling material that has a typical thickness of ½ inch or ⅝ inch. The rough opening 78 can be created for a new installation or it can be an existing rough opening in which an old fan is removed. In either situation, the rough opening 78 is prepped for the installation of the fan 100 and housing 10 of the present disclosure by sizing it to the correct dimensions of the housing 10.

After the rough opening 78 is prepared, the fan 100 and the housing 10 in which the fan resides are slid into the rough opening 78. The vent duct connector 68 is either already installed on the housing 10 as described above or it can be installed at this point by aligning the notches 76 with the upper L-shaped legs 62, then sliding the vent connector downward until it hits a stop 77 extending from the wall 20. The vent duct connector 68 can be installed before or after the housing 10 is placed through the rough opening 78. The vent duct connector 68 is then coupled to the ducting 72 by sliding the open end of the ducting over the nozzle portion 74 as described above.

The installer then repositions all the intermediate tabs 34 to about a 90 degree orientation with the respective wall 16, 18, 20, 22 when the structural member has a thickness of ⅝ inch. Alternatively, when the structural member has a thickness of about ½ inch, the installer will reposition the outside tabs 36 to an orientation of about 90 degrees with respect to the respective wall 16, 18, 20, 22. In either case, the tabs 34 or 36 are repositioned to face outwards away from the interior space 14 of the housing.

The housing 10 can now be placed over the rough opening 78 and will be supported on the top side or attic side 82 of the ceiling 80 by the respective intermediate tabs 34 or outside tabs 36. In this example the outside tabs 36 are used due to the thickness of the ceiling material 80. Next, the installer will reposition the center tabs 32 outward away from the interior 14 of the housing 10 to bear against the bottom side or room side 84 of the ceiling 80 to sandwich the ceiling 80 sheet rock between the center tabs 32 and the respective interior tabs 34 or outside tabs 36 as the case may be.

A key feature related to the housing design is that this installation can always be done from the room side and without the need for screws or attic access. In addition, this is particularly useful in situations where tools may not always be available. The tabs can be repositioned or bent more than once, ideally two, three, or more times without failure due to fatigue and in order to facilitate removal and reinstallation as needed.

As will be readily appreciated from the foregoing, this design allows the installer to put the fan housing 10 up inside the rough opening and move it out of the way to work on the vent duct connection and the electrical connection. Preferably eight intermediate or outside tabs 34, 36 hold the housing 10 in the opening from the attic or interior wall side, and the center tabs 32 are used to secure it to the sheet rock on the room side. However, it is to be understood that more than eight or fewer than eight intermediate or outside tabs can be used as desired.

The electrical connections are located towards the room side so the connection can be done from the room side. Another unique feature is the sheet rock grab with the tabs. The notches on the vent duct connector enable the slide-in installation of the vent duct connector 68 and room side electrical to be a combined true "room side" installation or retrofit. New construction has access to studs and attic, so this design and method works well for new construction. This high level of ease on the room side has never been done before.

Another unique aspect of this design is the plastic has two notches so the installer does not need to raise the plastic up as high to get it started in the four metal tracks. This feature allows for a shallow opening installation.

The weight of the fan body and the pinching of the metal tabs is enough to overcome the low fan vibration.

It is to be appreciated that various aspects of the housing 10 and vent duct connector 68, taken alone and in combination, provide an aesthetic appearance that extends beyond any functionality associated therewith. Non-limiting examples include radius of curvature, symmetry, and balance, use of geometric shapes not dictated by function, and the like.

Figure 12:
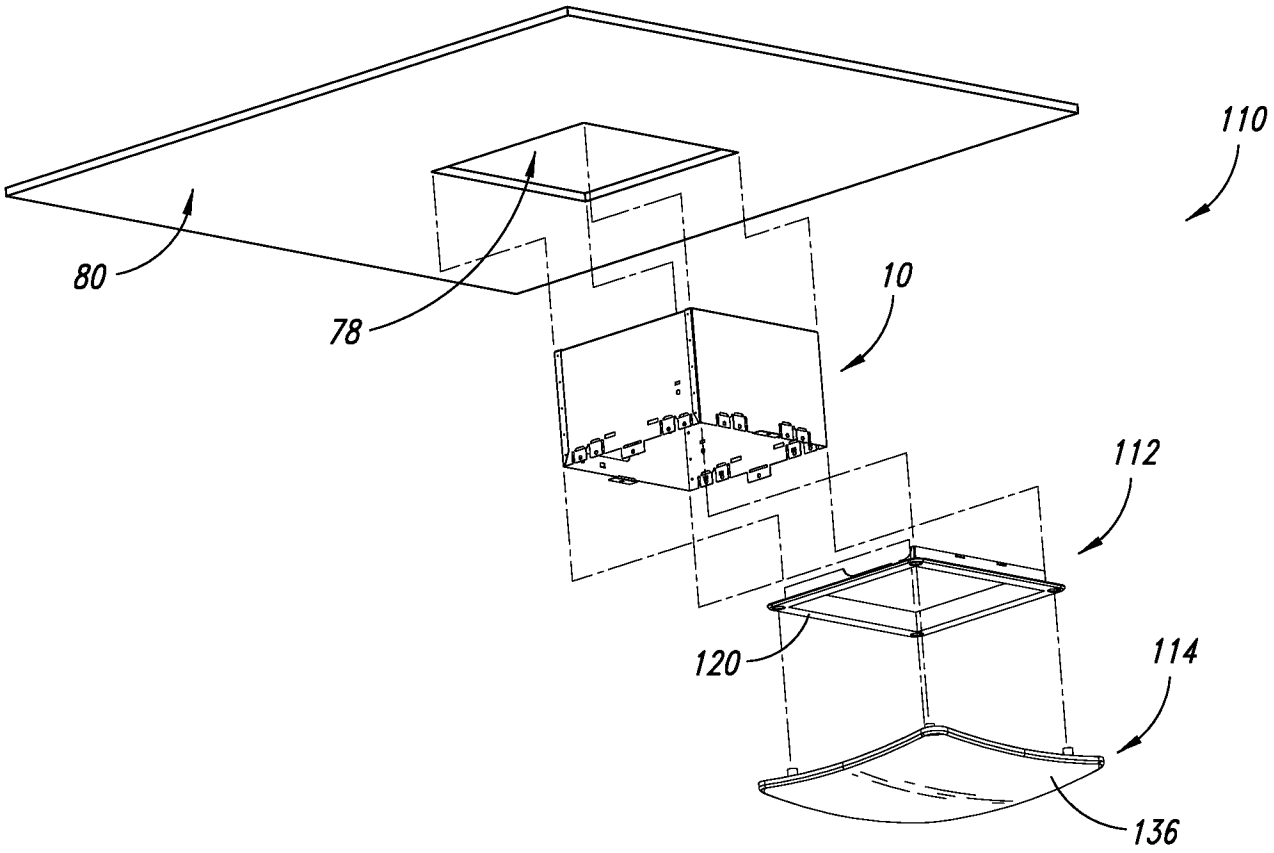
FIG. 12 is an isometric exploded view of a ventilation system formed in accordance with the present disclosure that utilizes the fan housing of FIG. 1.
Figure 13:
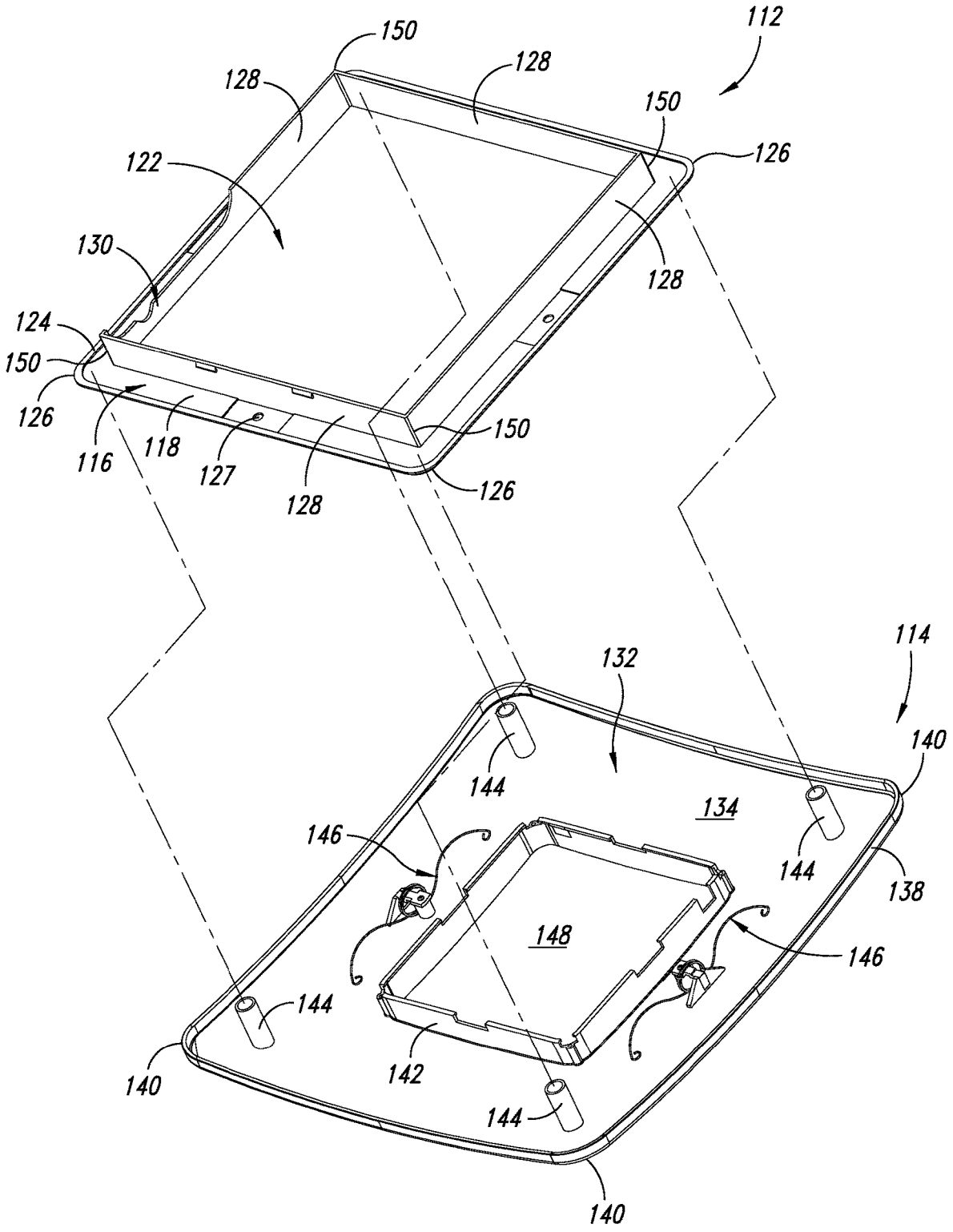
FIG. 13 is an axonometric exploded view of the relationship of a trim ring and grill cover used in the ventilation system of FIG. 12.
Figure 14:
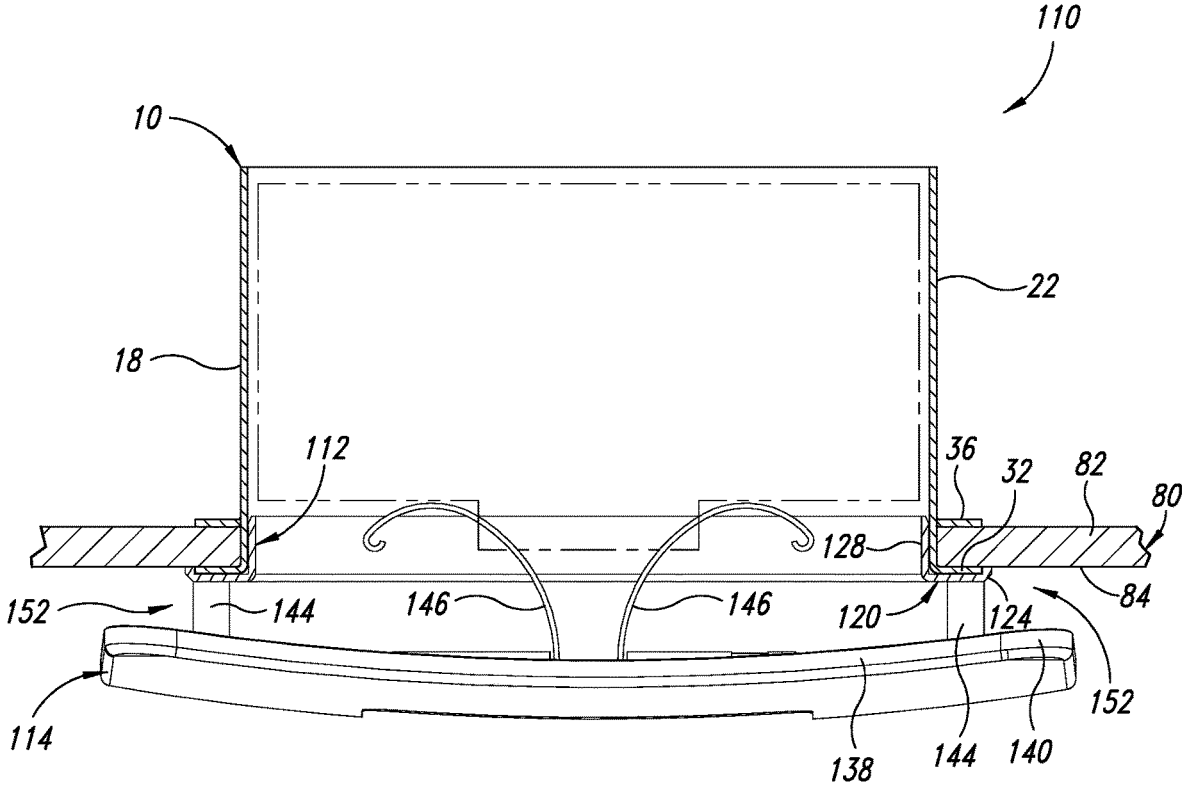
FIG. 14 is side view in partial cross section of the assembled ventilation system of FIG. 12.

Turning next to FIGS. 12-14, illustrated therein is a complete ventilation system 110 installation formed in accordance with another aspect of the present disclosure. As shown therein, the fan housing 10 is combined with a trim ring 112 and grill cover 114 to form a completed system 110 installation as shown in FIG. 14.

Figure 10A:
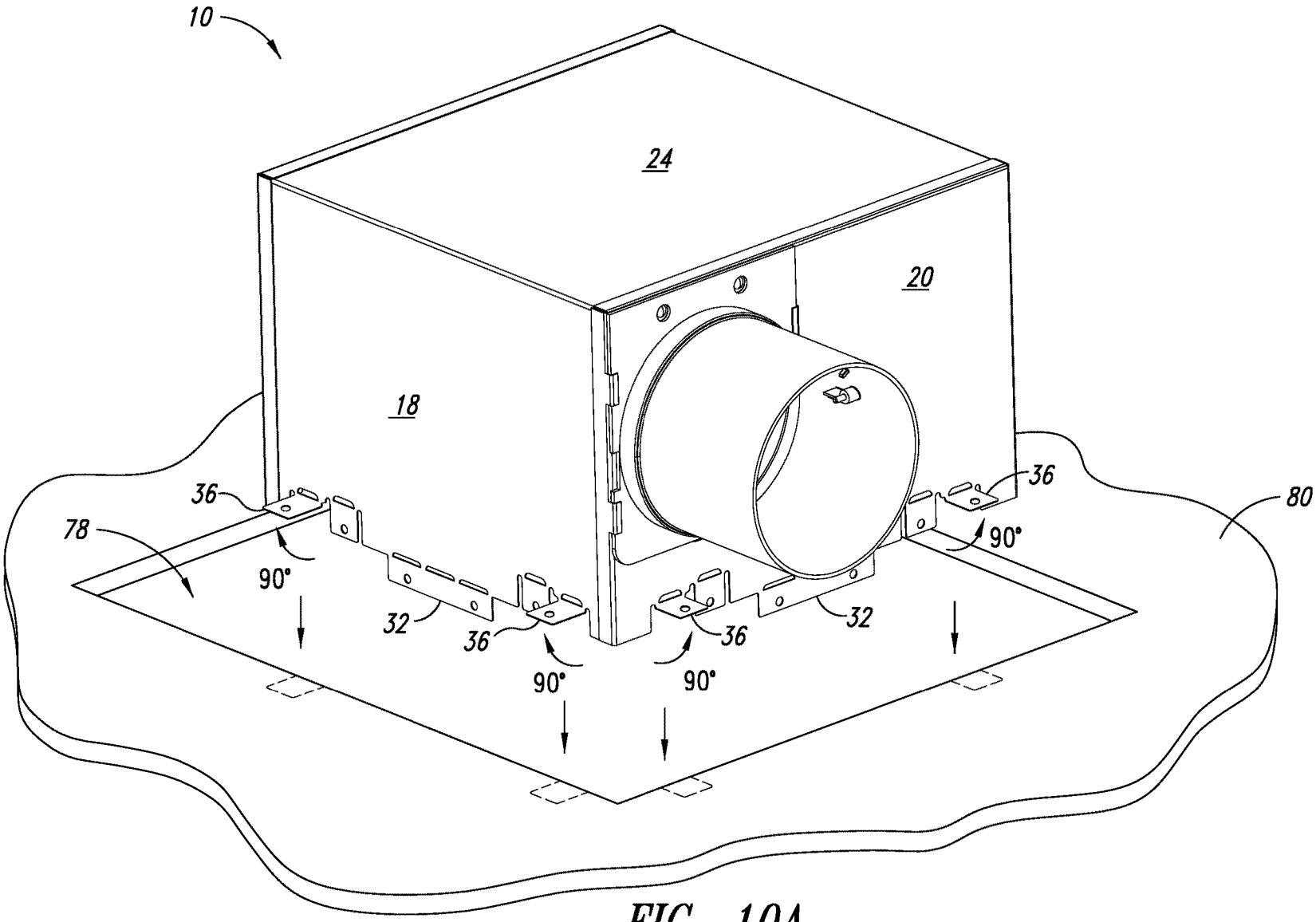
FIG. 10A is an illustration of the assembled housing and vent duct connector positioned above the rough opening with the outer tabs orthogonal to their respective walls.
Figure 10B:
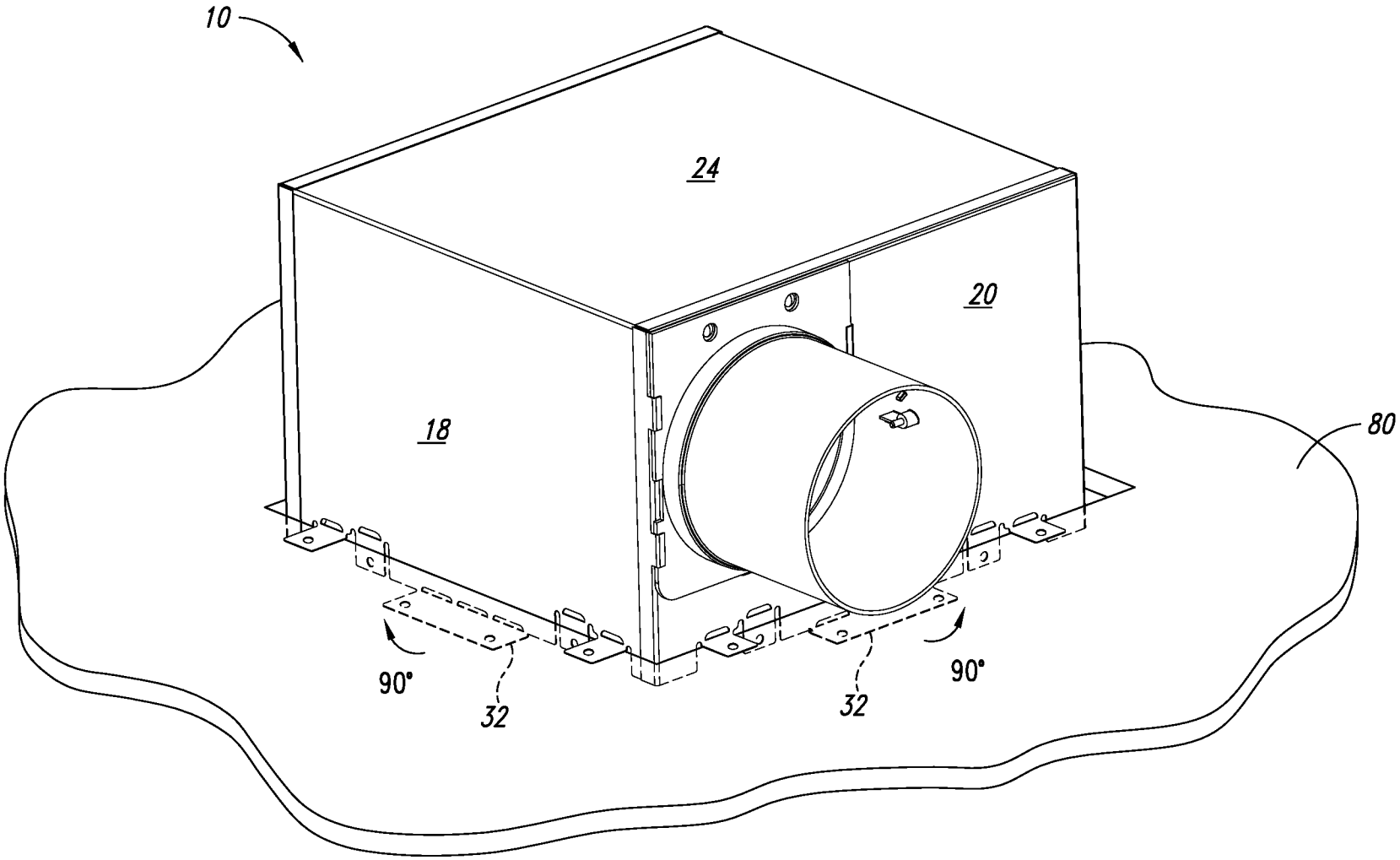
FIG. 10B is an illustration of the assembled housing and vent duct connector positioned in the rough opening and supported by the outer tabs on top of the structural member and held in place by the center tabs on an opposing side of the structural member.
Figure 11:
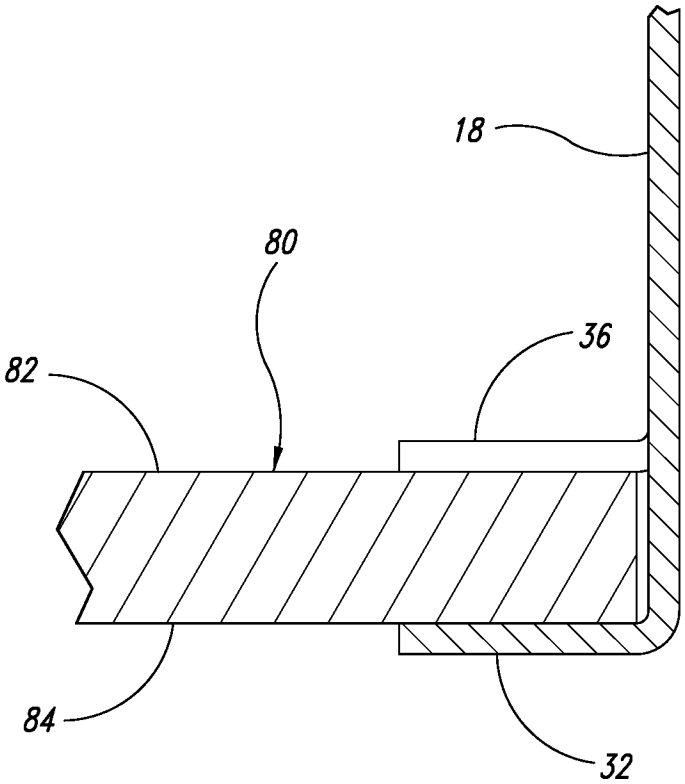
FIG. 11 is a partial cross-sectional side elevation showing the outer and center tabs holding the housing in place on the ceiling.

FIG. 12 is an isometric exploded view of the ventilation system 110 positioned below the rough opening 78 in the ceiling 80. The housing 10 is installed in the rough opening 78 as described above in connection with FIGS. 10A-11. Once the fan housing 10 is secured in place with the ducting, and the wiring is connected, the trim ring 112 is placed on the housing.

FIG. 13 is an axonometric exploded view of the trim ring 112 and the grill cover 114 showing the details of the interior of both. It is to be understood that many aspects of the trim ring 112 and grill cover 114 are ornamental in nature, including without limitation the size, shape, and symmetry of the exterior, such as the geometric shape, radius of curvature or lack thereof of the exterior corners, the thickness, the relative positioning of the trim ring 112 and grille cover 114.

As can be seen in FIG. 13, the trim ring 112 has a substantially square planform shape with a flat circumferential ledge 116 that has an interior surface 118 and exterior surface 120 (seen in FIG. 12) that circumscribes a central opening 122. The exterior edge of the ledge 116 has a lip 124 that is turned up towards the ceiling 80 when installed. The size and shape of the lip 24 accommodates the tabs on the housing 10, as will be explained in more detail in connection with FIG. 14 below. The four corners 126 on the trim ring 112 are rounded for appearance only, and the radius of curvature is chosen based on cosmetic appearance only. Optional punch-through depressions 127 are formed on the interior surface 118 of the ledge 116, centrally located on each side, for use in installation with fasteners if desired. These are not visible on the exterior surface 120 of the ledge 116.

An upstanding wall 128 is formed on an interior edge of the ledge 116 to circumscribe the opening 122. It is sized and shaped to fit inside the housing 10, as described more fully below in connection with FIG. 14. Ideally the trim ring has an interference fit or friction fit in the housing, including friction fit notches to hold it in place.

A cutout 130 is formed in one of the walls 128 that is sized and shaped to accommodate the vent duct connector 68 described above.

The grill cover 114 has a substantially square planform shape with a single wall 132 with an interior surface 134 and exterior surface 136. As can be seen more clearly in FIGS. 12 and 14, the grill cover 114 is concave on the interior surface 134 with an open top and correspondingly concave on the exterior surface 136 to form a closed bottom, similar to a shallow bowl. A lip 138 extends outward and away from the interior surface 134 and circumscribes the exterior of the grill cover. The four corners 140 of the grill cover 114 and the lip 138 are preferably rounded purely for cosmetic purposes. The radius of curvature is selected to cooperate with the corners 126 of the trim plate 112 to provide an attractive appearance.

An upstanding wall 142 is formed to circumscribe a middle portion of the interior surface 134 of the grill cover 114. The wall 142 has a height that is sized to avoid interfering with the housing 10 and the components inside the housing 10 when the grill cover is mounted thereon. The upstanding wall 142 forms an enclosure 144 that houses an optional lighting system that will not be described in detail herein. The grill cover 114 is preferably formed of translucent material that permits light to pass through without enabling viewing of the inside of the housing 10. The central area 148 bounded by the upstanding wall 142 may be clear if there is a cover attached to the wall 142 over the area 148. However, it is preferred that the material be translucent for the central area 148 as well as the entire grill cover 114.

A standoff 144 is formed adjacent each corner 140 to extend upward and away from the interior surface 134. Each standoff has a circular cross-sectional shape purely for ornamental reasons, and it is to be understood that they may have different cross-sectional shapes, such as square, hexagonal, octagonal, and other geometric shapes without affecting their function. The standoffs 144 are positioned to bear against the trim ring when the grill cover 114 is attached to the housing 10, thus assisting in holding the trim ring to the housing. The standoffs 144 further have a height from the interior surface 134 that is sized to space the wall 132 away from the ceiling 80 so as to provide a gap between the lip 138 and the ceiling 80 as described more fully below. Included on the grill cover 114 are a pair of spring clips 146 affixed to the interior surface 134 on opposing sides of the upstanding wall 142. These are conventional spring clips 146 that are readily commercially available and will not be described in detail herein. The clips 146 engage the housing 10 as described below to hold the grill cover 114 to the housing 10 with the standoffs 144 pressed against the trim plate 112, thus holding the trim plate 112 in place.

FIG. 14 is a side view in partial cross section of the assembled ventilation system 110. As can be seen, the housing 10 is held in place with the tabs 32 and 36 as described above. Once the housing 10 is attached to the ceiling 80, the trim ring 112 is slidably engaged with the housing so that the upstanding wall 128 bears against the inside of the respective one of the walls 16, 18, 20, 22 of the housing 10. Preferably the upstanding wall 128 extends upward only to the location of the bend line of the center tab 36, which is near the top surface 82 of the ceiling 80. When the grill cover 114 is installed, the ledge 116 will bear against the lower tab 32 with the lip 124 on the ledge 116 bearing against the bottom side or room side 84 of the ceiling 80. As can be seen, the height of the lip is sized to accommodate the thickness of the lower tab 32 so the trim ring prevents exposure of the tabs 32, 34 to view from the room side 84 of the ceiling 80. At this point, the trim ring 112 is held in place to the housing 10 by a friction fit between the walls 128 (and corners 150 of the walls 128) with the housing 80.

The grill cover 114 is then placed in position with the pair of springs 146 engaging the housing 10 in a conventional manner known to those of skill in the art. In one implementation the springs 146 engage slots (not shown) in the housing 10. The springs 146 allow the grill cover 114 to be pulled away from the ceiling 80 a short distance while still engaging the housing 10 through the springs 146. When the grill cover 114 is pushed further towards the ceiling 80 and the housing 10, the standoffs 144 will bear against the lower surface 120 of the trim ring ledge 116, thus holding the trim ring 112 in place. The standoffs 144 are sized to create a gap 152 between the lip 138 and the room side surface 84 of the ceiling 80 that allows air to be drawn into the housing 10 by the fan 100.

The various implementations described above can be combined to provide further implementations. These and other changes can be made to the implementations in light of the above-detailed description. In general, in the following claims, the terms used should not be construed to limit the claims to the specific implementations disclosed in the specification and the claims, but should be construed to include all possible implementations along with the full scope of equivalents to which such claims are entitled. Accordingly, the claims are not limited by the disclosure.

The invention claimed is:

1. An assembly for use in mounting an object in an opening in a structural member of a room, the structural member having opposing first and second surfaces, the assembly comprising:

a housing having an interior to house the object and sized and shaped to be received within the opening in the structural member, the housing has at least one wall that circumscribes the interior of the housing, the at least one wall having an interior face and a distal end;

a trim ring having a circumscribing ledge with an exterior surface and an interior surface, the circumscribing ledge defining a central opening, the trim ring further including an upstanding wall extending from the interior surface of the circumscribing ledge that is sized and shaped to fit within the interior of the housing, wherein the circumscribing ledge on the trim ring is substantially orthogonal to the upstanding wall, and the circumscribing ledge is sized and shaped to bear against the second surface of the structural member when the trim ring is mounted on the housing, and the upstanding wall on the trim ring is sized and shaped to bear against the interior face of the at least one wall of the housing adjacent the distal end thereof and in slidable engagement with the housing; and a cover having a panel sized and shaped to cover the trim ring, the cover having a connector assembly that releasably connects the cover to the housing, the cover further including at least one standoff extending from the panel that is sized to bear against the trim ring in response to connection of the cover to the housing.

2. The assembly of claim 1 wherein the circumscribing ledge on the trim ring has an interior edge that circumscribes the central opening, and the upstanding wall extends from the interior edge of the circumscribing ledge to be substantially orthogonal to the circumscribing ledge.

3. The assembly of claim 1, wherein the at least one wall of the housing has at least three walls that meet at at least three corners, and the upstanding wall of the trim ring has at least three corners, each corner of the upstanding wall sized and shaped to fit inside a respective corner of the at least three corners of the housing.

4. The assembly of claim 1 wherein the at least one standoff on the cover panel comprises at least two legs extending from the cover panel that are sized and shaped to hold the trim ring to the housing and the structural member and to position the cover panel away from the second surface of the structural member to enable air and vapor to pass between the second surface of the structural member and the cover panel and into the interior of the housing.

5. The assembly of claim 4 wherein the cover includes a light housing and the panel on the cover panel includes a lens positioned adjacent the light housing.

6. The assembly of claim 1 wherein the at least one standoff comprises at least two legs extending from the panel a first distance from the panel, the panel including at least one sidewall extending from the panel a second distance that is less than the first distance.

7. The assembly of claim 6 wherein the cover has four sides to form a square or rectangular planform shape, and the panel on the cover has a concave interior side and corresponding opposing convex exterior side.

8. An assembly for use in mounting an object in an opening in a structural member, the structural member having opposing first and second surfaces, the assembly comprising:

a housing that is sized and shaped to define an interior to house the object and that can be received within the opening in the structural member, the housing including:

a first tab extending from a distal end of the housing, the first tab sized and shaped to be bent to bear against the first surface of the structural member; and a second tab extending from the distal end, the second tab sized and shaped to engage the second surface of the structural member adjacent the opening and to attach the housing to the structural member;

wherein the first and second tabs are integrally formed with at least one wall, are co-planar with the at least one wall, and are formed of bendable material that retains a bent shape and can be bent more than once without failure, the first and second tabs having a thickness that enables manual bending of the first and second tabs from an original position to at least an angle of 90 degrees with respect to the at least one wall;

a trim ring having an upstanding wall extending from a ledge, the upstanding wall is sized and shaped to fit within the interior of the housing; and a cover having a panel sized and shaped to cover the trim ring, the cover having a connector that releasably connects the cover to the housing, the cover further including at least one standoff extending therefrom that is sized and shaped to bear against the trim ring to hold the trim ring in place.

9. A ventilation assembly for mounting a ventilation fan in an opening in a structural member without tools, the structural member having opposing first and second surfaces, the assembly comprising:

a housing that is sized and shaped to define an interior that is capable of housing the ventilation fan, the housing sized and shaped to be slidably received within the opening in the structural member;

a trim ring capable of attachment to the housing, the trim ring including a circumscribing ledge with an exterior surface and an interior surface, the circumscribing ledge defining a central opening, the trim ring further including an upstanding wall extending from the interior surface of the circumscribing ledge that is sized and shaped to fit within the interior of the housing, wherein the circumscribing ledge on the trim ring is substantially orthogonal to the upstanding wall; and a cover having a connector that releasably connects the cover to the housing;

wherein the housing includes:

a first tab extending from a distal end of a side wall of the housing, the first tab sized and shaped to be bent to bear against the first surface of the structural member; and a first tab extending from a distal end of a side wall of the housing, the first tab sized and shaped to be bent to bear against the first surface of the structural member; and a second tab extending from the distal end of the side wall, the second tab sized and shaped to bear against the second surface of the structural member adjacent the opening and to hold the housing to the structural member;

wherein the first and second tabs are integrally formed with the side wall and are co-planar with the side wall; and wherein the circumscribing ledge on the trim ring is sized and shaped to extend laterally beyond the first and second tabs on the housing when the first and second tabs are bent.

10. The assembly of claim 9 wherein the first and second tabs are formed of bendable material that retains a bent shape and can be bent more than once without failure, the first and second tabs having a thickness that enables manual bending of the first and second tabs from an original position to at least an angle of 90 degrees with respect to the side wall.

11. The assembly of claim 9, wherein the circumscribing ledge on the trim ring is substantially orthogonal to the upstanding wall, and the circumscribing ledge is sized and shaped to bear against the second surface of the structural member when the trim ring is mounted on the housing.

12. The assembly of claim 9 wherein the trim ring includes a lip extending from a distal edge of the circumscribing ledge in a first direction, the lip sized to have a length that is equal to or greater than a thickness of the first and second tabs.

* * * * *